US005363420A

United States Patent [19]

Polydor et al.

[11] Patent Number: 5,363,420

[45] Date of Patent: Nov. 8, 1994

[54] METHOD AND SYSTEM FOR INTERVENING ON THE SEALING PANE OF AN ORIFICE OF A CONFINED CELL

[75] Inventors: Gilles Polydor, Roquemaure; Jean-Claude Mathon, Sauveterre, both of France

[73] Assignee: Compagnie Generale des Matieres Nucleaires, France

[21] Appl. No.: 184,265

[22] Filed: Jan. 21, 1994

[30] Foreign Application Priority Data

Feb. 8, 1993 [FR] France ..... 93 01351

[51] Int. Cl.[5] ..... G21F 7/03

[52] U.S. Cl. ..... 376/287; 250/515.1; 976/DIG. 360

[58] Field of Search ..... 376/287, 463, 341, 342; 250/515.1; 414/8; 49/25, 63, 67, 68; 359/890, 894; 976/DIG. 359, DIG. 360

[56] References Cited

U.S. PATENT DOCUMENTS

| | | | |
|---|---|---|---|
| 2,957,210 | 10/1960 | Levenson | 250/515.1 |
| 3,064,967 | 11/1962 | Bonnet et al. | 976/DIG. 360 |
| 3,114,945 | 12/1963 | Bonnet et al. | 976/DIG. 360 |
| 3,433,957 | 3/1969 | Nelson | 976/DIG. 360 |

FOREIGN PATENT DOCUMENTS

| | | |
|---|---|---|
| 0078967 | 12/1960 | France . |
| 2462769 | 7/1979 | France . |
| 3930945 | 3/1991 | Germany . |

OTHER PUBLICATIONS

Bottenfield et al, Remote Maintenance Systems in the Transuranium Processing Plant-Proceedings of the 14th Conference on Remote Systems Technology-Oct. 11, 1966, pp. 172-184.

*Primary Examiner*—Daniel D. Wasil

*Attorney, Agent, or Firm*—Pearne, Gordon, McCoy & Granger

[57] ABSTRACT

This system is able to intervene on the inner pane (2) of a "high activity' cell whilst ensuring the biological and radiological protection of operators.

It includes means able to extract the shielding window (5) of the orifice and a protective screen (7) mounted moving with respect to a fixed structure (20, 21) and intended to block up the orifice of the cell when the shielding window (5) is extracted. It includes handling means, such as pliers (32), for intervening on the pane (2) with equipment able to be passed through the shield (7) by means of a spring barrel (36).

Application for cleaning of the sealing pane (2) on "high activity" screened cells.

13 Claims, 1 Drawing Sheet

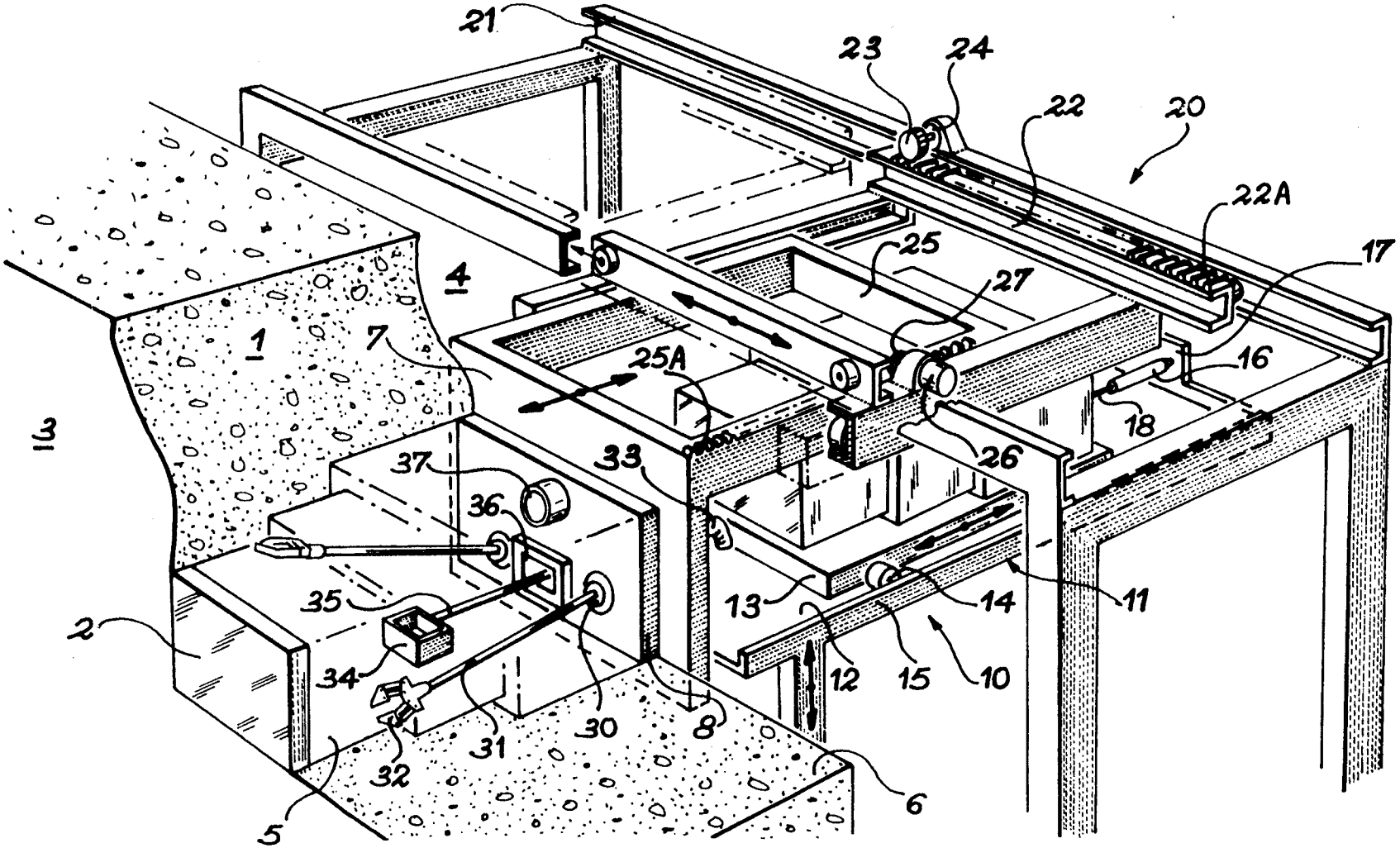
17
22A
16
20
18
11
22
27
26
14
10
24
25
15
6
23
12
13
8
25A
33
30
21
36
31
4
37
7
32
35
34
5
1
2
31

METHOD AND SYSTEM FOR INTERVENING ON THE SEALING PANE OF AN ORIFICE OF A CONFINED CELL

FIELD OF THE INVENTION

The invention concerns "high-activity" type confined cells in nuclear facilities or screened cells, inside which works are carried out on iradiated objects. In particular, the invention concerns the maintenance of a pane situated in the orifice, making it possible to follow up and control the course of these work operations. The biological protective shielding window is also situated in this orifice.

However, it is possible to envisage that the invention is used in other industrial sectors, for example in chemistry with chemical preparation of highly toxic products.

BACKGROUND OF THE INVENTION

In the nuclear field, there are a number of installations comprising shielded enclosures or cells inside which work operations are carried out making it possible to qualify this type of "high activity" cells. Work operations are carried out inside this type of cell, namely the dismantling of certain irradiated units, the processing of certain irradiated fuels and all operations unable to be carried out by human operators owing to the lack of bilogical and radiological protection. These cells have several orifices with at least one orifice being used for control, visualizing and the follow-up of the operations carried out inside the cells. Most of the time, these orifices include one internal pane intended to ensure the protection of outside operators against alpha radiations, and a shielding window intended to provide the biological protection of operators outside the cell.

As shown on the FIGURE, the orifice concerned has been shown as a section by the draftsman so as to see clearly in the wall 1 of the enclosure of the cell the internal pane 2 placed towards the inside 3 of the cell, and a shielding window 5 placed on the outer side 4 of the wall 1, but much thicker than the pane. The latter is transparent, with a thickness of between 30 to 40 millimeters and is made of lead glass. The shielding window 5 has a particular "staircase" type shape enabling it to ensure highly effective biological protection against the various radiations. Its thickness is preferably complementary to that of the pane 2 so as to occupy the entire thickness of the wall 1 of the cell.

During a certain number of months of use of the cell, it is frequent that vision through the orifice is altered by a soiling of the face of the pane 2 located against the shielding window 5. It may be that in particular humidity occurs between these two elements and that observation through the orifice is either altered or no longer satisfactory. It is then vital to clean this outer face of the pane 2 located against the shielding window 5.

Several methods have been used to clean this protection pane 2.

One first solution consists of emptying the inside of the cell of the irradiating equipment it contained, but this operation is not always reliable for reasons of storage and creates operating restraints.

One second operation consists of constructing inside 3 the cell in front of the pane 2 a lead protection biological wall. On the other hand, this material is then contaminated, which of necessity poses a problem of decontaminating this element, thus creating other operation restraints.

SUMMARY OF THE INVENTION

To this effect, one first object of the invention concerns providing a method for intervening on the sealing pane of an orifice of a "high activity" or shielded type cell, the orifice including a shielding window placed in front of the pane on the outer side of the cell. The method consists of:

a) removing the shielding window by pulling it up from outside the cell;

b) instantly placing on the outer side of the orifice a protective screen so as to fully block it off and remote handling means disposed on the protective screen so as to carry out from outside operations on the pane;

c) remove the protective screen once the operations to be made have been completed, and d) put back the shielding window.

Another main object of the invention is an intervention system for implementing this method, this system being placed in front of the pane on the outer side of the cell. The system includes:

a frame for extracting and introducing the shielding window, and a portico for handling a protective screen to be placed in front of the orifice, the protective shield including remote handling means for acting on the outer face of the pane from outside.

The main embodiment of the frame provides that the latter includes:

a fixed table;

a lower frame able to roll on the fixed table, and means for extracting the shielding window, said means being fixed to the table so as to place the shielding window on the lower frame.

In this case, the extraction means are preferably constituted by hydraulic jacks fixed to the table whose rod is equipped with means for picking up the shielding window.

The portico preferably has:

a structure;

one first upper frame suspended from the structure and mobile along a first horizontal direction;

a second upper frame suspended from the first frame and mobile along a second direction perpendicular to the first direction.

The handling means preferably include:

two pot type joints;

two pliers mounted on the two pot type joints and placed on the side of the pane, and two handles for the remote handling of the two pliers.

The protective screen preferably has vision means enabling observers to carry out operations on the pane.

In this case, these vision means preferably are a pane loaded with lead or a video camera.

The protective screen preferably has means for transferring equipment through itself.

These transfer means preferably are constituted by:

a spring barrel rotating in the protective screen and comprising a passage;

a boat placed at the end of a rake rod, these two objects being able to pass through the passage of the protective screen.

The protective screen is preferably made of lead.

When it is placed inside the orifice, it may be completed by a lower flap taking support on the lower surface of the orifice for ensuring biological protection.

BRIEF DESCRIPTION OF THE DRAWING

The FIGURE shows a system for intervening on the sealing pane of an orifice of a shielded cell.

DETAILED DESCRIPTION OF ONE EMBODIMENT OF THE INVENTION

The first operation of the intervention method of the invention consists of removing the shielding window 5 from the orifice of the wall 1. Having regard to the fact that the pane 2 needs to stay in place, the shielding window 5 needs to be pulled outwardly 4 from the chamber. Secondly, as the thickness of the wall 1 may reach one meter twenty centimeters and the section of the orifice one square meter and as the material constituting the shielding window 5 is made of special glass, the weight of the shielding window may reach eight tons. Thus, it is necessary to provide a special item of equipment to extract the shielding window 5 and free it from the orifice so as to intervene on the pane 2. Accordingly, a chassis 10 has been provided to extract and introduce the shielding window in the orifice and is laid on the ground outside 4 the chamber opposite the orifice. The embodiment described shows that the frame is preferably made of a fixed table 11 laid on the ground and whose upper surface is flush with the lower surface 6 of the orifice. A frame 13 on this table is able to be moved by means of rollers 14 rolling against the corners 15 of the table 11 in a direction perpendicular to the wall 1. Thus, when the lower frame 13 is against the wall, it is ready to receive the shielding window 5 with the aim of spacing it from the wall 1. Of course, the lower frame 13 may accordingly be brought closer to the wall 1 so as to bring the shielding window 5 back towards the orifice once the operations on the pane 2 have been completed.

Therefore, means are provided to extract the shielding window so as to have it slide outside the orifice of the wall 1. These extraction means may be formed of jacks 16 mounted fixed with respect to the distant end 17 of the table 11 and whose rod 18 is able to pull up the shielding window 5 by means of grips (not shown on the FIGURE). Nevertheless, fastening hooks or rings may be provided on the shielding window enabling the rods 18 of the jacks 16 to take support on each side of the shielding window so as to extract it from the orifice.

The corners 15 of the table 11 may be equipped with line rules enabling operators to control or synchronize the actions of each of the hydraulic Jacks when the shielding window is handled.

The means enabling the first operation to be carried out, that is the extraction of the shielding window, and the final operation, that is the putting back of the shielding window into the orifice of the wall 1, have just been described.

The second operation of the method consists of immediately placing a protective screen 7, preferably made of lead, once the shielding window 5 has been extracted. On the side of the pane 2, the protective screen 7 preferably has an excess thickness 8 whose perimeter corresponds to that of the orifice so that this excess thickness 8 can be introduced into the orifice. The rest of the protective screen 7 covers the latter by taking support against the wall 1.

In fact, the protective screen 7 forms part of a portico 20 installed outside 4 the chamber above the frame 10 and intended to handle the protective screen.

As shown on the FIGURE, the portico 20 is preferably constituted by a metallic sectional structure 21 mounted above the frame 10. It supports one first upper carriage 22 mounted translation-mobile on the structure 21 parallel to the wall 1 of the chamber. To this effect, it is possible to use upper racks 22A on the girders of the frame 22 on which gears is the wheel 23 of a translation motor 24 secured to the structure 21.

The protective screen 7 is integral with a second upper carriage 25 mounted translation-mobile on the first upper carriage 22 in a direction perpendicular to the wall 1, that is in the direction for extracting the shielding window 5. Racks 25A may also equip this second upper carriage 25, the translation-driving of the latter being ensured with the aid of a motor 26 driving a toothed wheel in the rack 25A of the second upper carriage 25.

With the structure 21 of the portico 20 secured, the protective screen 7 may be moved inside a plane parallel to the ground, that is be brought closer to or spaced from the wall 1 or moved parallel to the latter. Thus, it is possible to keep the protective screen 7 at a distance from the orifice of the wall 1 when the shielding window 5 needs to be extracted and then move it rapidly opposite the orifice against the wall 1 once the shieding window 5 has been extracted.

Once the protective screen 7 is in place against the wall 1, the biological protection of operators is ensured. The operations on the pane 2 may then be carried out. A particular use of this system is to clean the outer surface of the pane 2, that is the surface opposite the shielding window 5. It is thus vital to have handling means disposed on the protective screen 7.

To this effect, the FIGURE represents two arms 31 mounted pivoting in the protective screen 7 by means of two pot type joints 30 inserted in the thickness of the protective screen 7. These two arms 31 each bear at their extremity a pair of pliers 32. Thus, it is possible to carry out operations by virtue of these handling means, such as operating handles 33. In fact, this protective screen 7 is equipped with a set of pliers manufactured by the EURITECH company whose reference is "right or left pliers B C 3 with cable transmission". These pliers, as their name indicates, possess a cable transmission for its tightening. The pot type joints used may be made of lead and/or PVC depending on their use.

The effectiveness of the tightening of the pliers 32 is always important, even with lengths of large arms. The pliers 32 may be replaced by joining pieces, handles or other clamping pliers.

In order to clean the pane 2, it is essential to have cleaning elements, such-as sponges, mops, scrapers or drying devices. To this effect, transfer means are installed on the protective screen 7 for these types of cleaning elements. For example, they may be constituted by a boat 34 fixed to the end of a rake rod 35. These means are passed through the protective screen 7 by means of a spring barrel 36 placed inside the protective screen. This spring barrel has a central passage with a width larger than or equal to the width of the boat 34. When the groove of this spring barrel 36 is in a position perpendicular to the wall 1, the rake rod 35 and the boat 34 are able to traverse the protective screen 7. Before and after the use of this boat 34, the spring barrel is rotated by ninety degrees so that its groove is parallel to the wall 1 and fully blocks off the orifice of this spring barrel 36.

So as to carry out, monitor and control the operations made to the pane 2, the protective screen is equipped with vision means constituted, for example, by a pane 37 loaded with lead and placed in the protective screen 7. This pane 37 constitutes a shielding window for the operators before carrying out any cleaning operations to the pane 2. These vision means may possibly be constituted by a video camera, an infrared camera or any other video sensor system centered on the inside 3 of the cell.

The protective screen 7 has been shown on the FIGURE applied to the wall 1 against the outer surface of the latter. It may be envisaged that the protective screen is smaller than the section of the orifice in the wall 1 and may be introduced into the latter. In this case, at least one rib of this protective screen may be completed by a lower foldable flap intended to fill up the play which then existed between the protective screen and one of the surfaces of the orifice, for example the lower surface 6. Thus, the biological protection of operators shall be ensured.

The described embodiment of the present invention has merely been cited by way of example. In fact, in this case, it makes it possible to change or upkeep the elements to be renovated, replaced or dismantled. It is to be noted that the mechanical system constituted by the portico 20 allowing for a longitudinal effacing of the protective screen 7 may be replaced by a mechanical system with vertical effacing according to the better disposition linked to the environment of the appication in question.

Secondly, it is also possible to envisage incorporating in the protective screen a large lock or spring barrel making it possible to produce remote control intervention machines for carrying out various tasks inside the cell (maintenance, renovation or dismantling).

Similarly, sealing elements may be associated with the protective screen with respect to alpha or gamma radiations.

Advantages of the Invention

1) The method and system of the invention make it possible to render operational the main members, such as the vision pane installed in a large number of old cells which need to be continued to be used;

2) This type of system may become a tool with a huge range of applications as part of chain dismantlings of shielded cells or "high activity" cells;

3) The system is able to intervene quickly and according to a relatively simple method in satisfactory radiological conditions with respect to current standards;

4) Thus, it makes it possible to avoid using heavy expensive infrastructures for carrying out operations, such as the maintenance of the pane of the orifice of the shielding window of a cell.

Similarly, sealing elements may be associated with the biological protective screen so as to obtain protection with regard to alpha or gamma radiations.

What is claimed is:

1. Method for intervening on a sealing pane of an orifice of a shielded cell, the orifice including a shielding window placed in front of the pane on the outer side of the cell, said method consisting of:

a) removing the shielding window by pulling it outwardly;

b) immediately placing after stage a) on the outer side of the orifice a protective screen for blocking it off completely, and remote handling means placed on the protective screen so as to carry out outside the operations on the pane;

3) remove the protective screen, and 4) put back the shielding window in the orifice.

2. System for intervening on the sealing pane of an orifice of a shielded cell and possessing a shielding window placed in front of the pane on the outer side of the cell and including:

a frame for introducing and extracting the shielding window, a protective screen including remote handling means for acting on the outer face of the pane from the outside, and a portico for handling the protective screen to be placed in front of the orifice.

3. Intervention system according to claim 2, wherein the frame includes:

a fixed table;

one lower carriage mounted rolling on the table, and means for extracting the shielding window and fixed to the table so as to place the shielding window on the lower carriage and also to then replace it in the orifice.

4. Intervention system according to claim 3, wherein the extraction means are formed of hydraulic jacks fixed to the table and whose rod is equipped with means for picking up the shielding window.

5. Intervention system according to claim 2, wherein the portico includes:

a fixed structure;

one first upper carriage suspended from the structure and mobile horizontally with respect to the wall of the cell;

one second upper carriage suspended from the first carriage and mobile horizontally with respect to the latter in a direction perpendicular to the wall of the cell.

6. Intervention system according to claim 2, wherein the handling means include:

two pot type joints;

two pairs of pliers mounted pivoting in the pot type joint so as to be placed on the side of the pane of the cell;

two handles for the remote handling of the two pliers.

7. Intervention system according to claim 2, wherein the protective screen has vision means inside the cell.

8. Intervention system according to claim 7, wherein the vision means are formed of a pane loaded with lead.

9. Intervention system according to claim 7, wherein the vision means are constituted by a video camera.

10. Intervention system according to claim 2, wherein the protective screen possesses means for transfer through itself.

11. System according to claim 10, wherein the transfer means include:

a spring barrel mounted rotating inside the protective screen and including a passage, a boat placed at the end of a rake rod, these two objects able to pass through the passage of the spring barrel.

12. Intervention system according to claim 2, wherein the protective screen is made of lead.

13. Intervention system according to claim 2, wherein the protective screen has a lower flap taking support on the lower surface of the orifice so as to provide biological protection when the protective screen is inserted inside the orifice.

* * * * *